United States Patent [19]

Jerry

[11] Patent Number: 4,912,901

[45] Date of Patent: Apr. 3, 1990

[54] COLUMN SHAPED JACKET

[76] Inventor: Frederick L. Jerry, 21331 Kipling St., Oak Park, Mich. 48237

[21] Appl. No.: 141,554

[22] Filed: Jan. 7, 1988

[51] Int. Cl.[4] ..... E04C 3/30

[52] U.S. Cl. ..... 52/301; 52/311; 52/727; 52/731

[58] Field of Search ..... 52/301, 311–316, 52/727, 725, 731, 728

[56] References Cited

U.S. PATENT DOCUMENTS

| | | | |
|---|---|---|---|
| 83,425 | 10/1868 | Walters et al. | 52/731 |
| 232,274 | 9/1880 | Kelly | 52/731 |
| 399,202 | 3/1889 | Mesker et al. | 52/731 |
| 950,806 | 3/1910 | Richardson | 52/301 |
| 1,350,686 | 8/1920 | Trudelle | 52/727 |
| 3,511,006 | 5/1970 | Medow | 52/311 X |
| 3,714,750 | 2/1973 | Pallotto | 52/728 |
| 3,842,557 | 10/1974 | Brown | 52/311 X |
| 4,035,978 | 7/1977 | Bajorek et al. | 52/727 |
| 4,038,802 | 8/1977 | Bajorek et al. | 52/311 X |
| 4,467,584 | 8/1984 | Crites et al. | 52/727 |

FOREIGN PATENT DOCUMENTS

| | | | |
|---|---|---|---|
| 554271 | 6/1943 | United Kingdom | 52/727 |

*Primary Examiner*—Richard E. Chilcot, Jr.

[57] ABSTRACT

The object of the invention is to provide a column shaped jacket that can be made in many shapes and designs, to be attached to a common square shaped support post of a porch canopy, to give it the appearance of a column and add support strength. In that accomplishment the said shaft having shaft members provided with combination former-adapter members having a recess that fit a support post, and slots into which fit stringers that add more strength to the shaft members into which fit the said capital and the base that themselves have a recess that assist in the attachment of the shaft to the said support post.

Other objective is to provide a column shaped jacket with application means to make it possible for homeowners without any carpentry skill to attach it to the support post of a porch canopy or roof.

4 Claims, 1 Drawing Sheet

FIG. 2
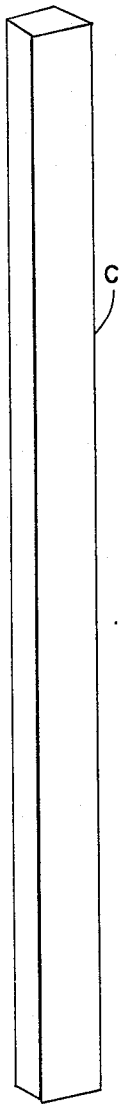
FIG. 1
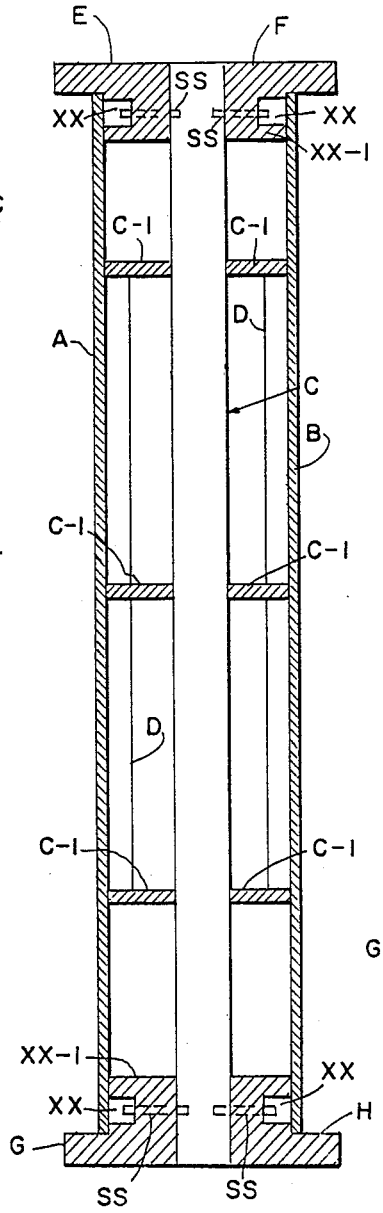
FIG. 3
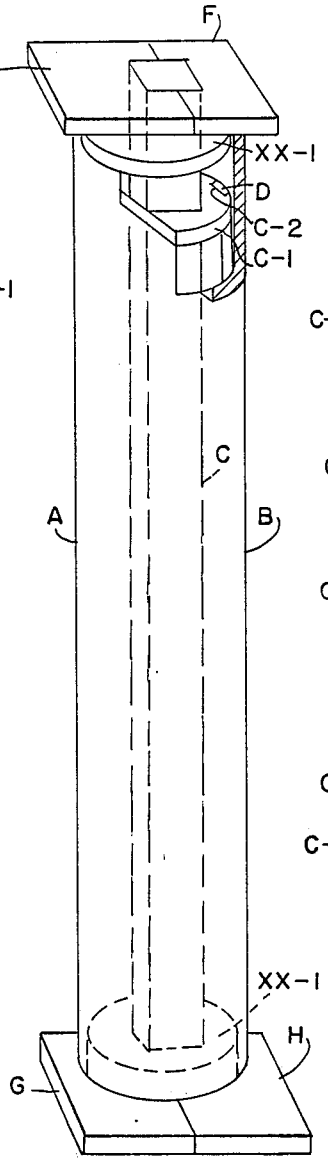
FIG. 4
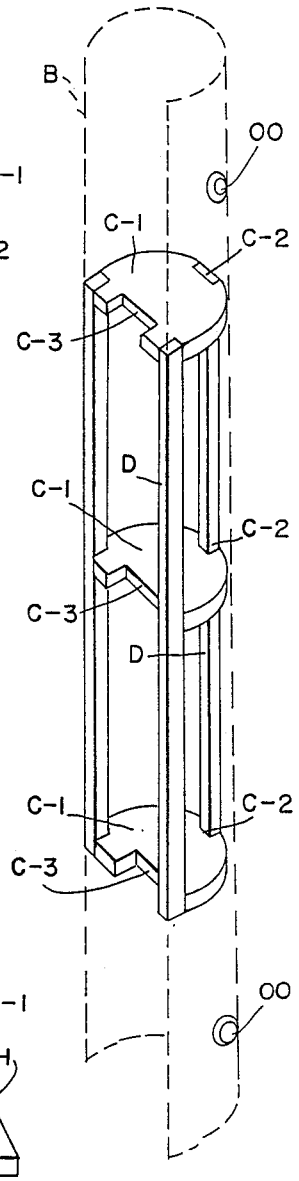
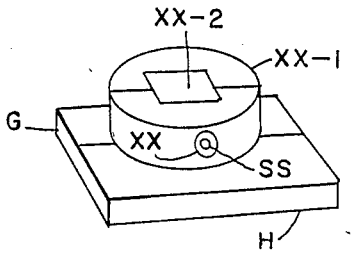
FIG. 5

COLUMN SHAPED JACKET

My invention relates to improvement in encasement articles, such as a decorative cover for a support post for a porch canopy or roof, with prime objective being to devise a Column Shaped Jacket that being attached to a common square support post of a porch canopy or roof changes its appearance to that of a column; and add support strength thereto by reason of the frameworks provided therein the column jacket.

Other objective of the invention is to devise a column shaped jacket that can be made in various shapes and decorative designs, there offer a choice of shapes and decorative appearance to the common square shaped appearance to the support post when the column shaped jacket is attached thereto.

TECHNICAL FIELD

My invention relates to improvement in square shaped support post appearance, and thereby to be employed in connection with the field of home and commercial canopy or roof, wherein the once solid or very massive and heavy column of old was used. Column construction that offered decorative appearance, at a great disadvantage by reason of its massive size, great expense and the great skill of experienced craftmen to install. These disadvantages and great expense my invention of a column Shaped Jacket has overcome.

BACKGROUND ART

The background art of a support post that replaced the previous art of support column, offer the same common square shaped appearance no matter how different the design of the building, porch canopy or roof it support.

My invention the Column Shaped Jacket being made in different shapes and decorative designs, give the home-owner or buildings a choice of changing the common square shape appearance of the support post and add support strength when the invention is attached thereto.

DISCLOSURE OF THE INVENTION

The invention of an Column Shaped Jacket consisting of a capital, shaft and a base, can be made out of plastic or metal. The invention's framework members besides adding strength to the support post, add strength to the said Jacket's shafts that cover the framework members. Further advantage of the Column Shaped Jacket is its unique means for application that make it possible for an unskilled person to attach it to the support post of an porch canopy or roof.

BRIEF DESCRIPTION OF THE DRAWINGS

The detail of my invention will be described in connection with the accompanying drawings, in which FIG. 1. is an vertical section of the entire Column Shaped Jacket attached to support post;

FIG. 2 is a perspective view of a support post without the invention attached thereto;

FIG. 3 is a perspective view of the enitre Column Shaped Jacket with a cutaway view;

FIG. 4 is a perspective detail view of the framework, with a halve of the shaft shown in brokenlines;

FIG. 5 is a perspective detail view of the base.

BEST MODE FOR CARRYING OUT THE INVENTION

The arrangement of the combination former-adapters illustrated in

FIG. 4, reveal an elongate framework consisting of a series of combination former-adapter members that are provided with a slot C-3 to fit a support post C, and slots C-2 into which fit stringers D. Referring to the drawings, and in particular FIG. 3, where there is shown the Column Shaped Jacket in an assembled union with an unrelated support post C. The construction of the Column Shaped Jacket illustrated in FIG. 1, shows a pair of elongate shaft members A and B that are provided with capital members E and Fat their top, that are made with a tenon like projection XX-1 provided with a niche XX-2 (see FIG. 5) to fit a support post and a recess XX that correlate with the hole 00 in the said shaft members A and B. The said shaft members A and B is also provided with base members G and H therein at their bottoms, with the said base members G and H provided with tenon like projection XX-1 provided with niche XX-2 to fit a support post and a recess XX that receive a screw SS and correlate with the hole 00 in the said shaft member A and B. The said shaft members A and B is further strengthen by the pair of framework assemblies comprising a series of combination former-adapter members C-1 having a slot C-3 adapted to fit a support post and slots C-2 spaced into which fit stringers D that hold the said combination former adapters C-1 in position. The said shaft members A and B when fasten together by said screw fastenings thru the said recess XX form an complete Column Shaped Jacket and thereby contain the said frameworks therein. The application of the Column Shaped Jacket to an support post, give it the appearance of an Column and add strength.

What is claimed is:

1. A decorative column jacket assembly for covering a support post, said jacket assembly comprising: a base having a recessed area disposed therein for receiving a lower end of said post, a capital member having a recessed area disposed therein for receiving an upper end of said post; a first framework assembly disposed on one side of said post and a second framework assembly disposed on the other side of said post; each of said framework assemblies comprising a plurality of vertically spaced, semi-circular shaped, adapter members, said adapter members including a substantially flat end having a notch disposed therein for receiving said post and a plurality of circumferentially spaced notches for receiving a plurality of support stringers, which space and support said adapter members; and first and second semi-circular cover members, each of said cover members being disposed over each of said respective framework assemblies and are attached to said base and said capital.

2. A decorative column jacket assembly as in claim 1, wherein said base is formed of multiple parts.

3. A decorative column jacket assembly as in claim 1, wherein said capital is formed of multiple parts.

4. A decorative column jacket assembly as in claim 1, wherein each of said cover members have means disposed therein for receiving a plurality of fasteners, which attach said cover members to said base and capital.

* * * * *